US010227743B2

(12) United States Patent
Nakazawa et al.

(10) Patent No.: US 10,227,743 B2
(45) Date of Patent: Mar. 12, 2019

(54) APPARATUS, PROGRAM, AND METHOD FOR CONTROLLING AUTOMATIC SPRAY OF ANTIFREEZING AGENT

(71) Applicant: BRIDGESTONE CORPORATION, Tokyo (JP)

(72) Inventors: Kazuma Nakazawa, Tokyo (JP); Yasumichi Wakao, Tokyo (JP); Go Nagaya, Tokyo (JP); Shinya Tsuchida, Tokyo (JP); Yasushi Hanatsuka, Tokyo (JP); Hiroshi Morinaga, Tokyo (JP); Tomonori Ohiro, Hokkaido (JP)

(73) Assignee: BRIDGESTONE CORPORATION, Chuo-ku, Tokyo (JP)

( * ) Notice: Subject to any disclaimer, the term of this patent is extended or adjusted under 35 U.S.C. 154(b) by 0 days.

(21) Appl. No.: 15/033,734

(22) PCT Filed: Nov. 6, 2014

(86) PCT No.: PCT/JP2014/079499
§ 371 (c)(1),
(2) Date: May 2, 2016

(87) PCT Pub. No.: WO2015/068778
PCT Pub. Date: May 14, 2015

(65) Prior Publication Data

US 2016/0281312 A1 Sep. 29, 2016

(30) Foreign Application Priority Data

Nov. 6, 2013 (JP) ..... 2013-230606

(51) Int. Cl.
*E01H 10/00* (2006.01)
*B05B 12/12* (2006.01)
*B05B 13/00* (2006.01)

(52) U.S. Cl.
CPC ..... *E01H 10/007* (2013.01); *B05B 12/12* (2013.01); *B05B 13/005* (2013.01)

(58) Field of Classification Search
CPC ..... B05B 12/12; B05B 13/005; E01H 10/007; G08G 1/0967; G08G 1/086791; B60G 17/0165
(Continued)

(56) References Cited

U.S. PATENT DOCUMENTS 5,220,876 A 6/1993 Monson et al.
7,370,818 B2 * 5/2008 Ward ..... E01H 10/007 239/146
(Continued)

FOREIGN PATENT DOCUMENTS

JP 04-130315 U 11/1992
JP 11-229311 A 8/1999
(Continued)

OTHER PUBLICATIONS

Communication dated Mar. 2, 2017, from the European Patent Office in counterpart European application No. 14860114.9.
(Continued)

*Primary Examiner* — Alexander Valvis
*Assistant Examiner* — Christopher R Dandridge
(74) *Attorney, Agent, or Firm* — Sughrue Mion, PLLC

(57) ABSTRACT

The invention provides an apparatus, program, and method for controlling the automatic spraying of an antifreezing agent that can reduce the cost of the antifreezing agent and the impact of salt damages caused by the antifreezing agent. This is accomplished by reducing the amount of antifreezing agent to be sprayed automatically according to road surface condition and reducing the amount of the antifreezing agent left unused on completion of the spray operation by grasping in advance the total spray amount of the antifreezing agent. Thus, the antifreezing agent automatic spray control apparatus comprises a spray section setting unit for setting a spray section, a road surface condition data acquiring unit
(Continued)

for acquiring road surface condition data, a spay condition data acquiring unit for acquiring spray condition data, a spray condition determining unit for determining the spay conditions for each of unit sections, a total spray amount advance calculating unit for calculating in advance the total spray amount of antifreezing agent to be sprayed for the spray section, a current position data acquiring unit for acquiring current position data, a unit section identifying unit for identifying a unit section corresponding to the current position, and a spray condition outputting unit for outputting the spray conditions for each of the unit sections to an antifreezing agent spraying unit.

1 Claim, 11 Drawing Sheets

(58) Field of Classification Search
USPC ..... 244/134 R, 134 C, 134 F
See application file for complete search history.

(56) References Cited

U.S. PATENT DOCUMENTS 8,275,522 B1 * 9/2012 Groeneweg ..... G06Q 10/06 701/50
8,902,081 B2 * 12/2014 Groeneweg ..... G08G 1/096775 340/905
2007/0039371 A1 * 2/2007 Omata ..... G01N 29/11 73/9
2009/0105921 A1 * 4/2009 Hanatsuka ..... B60G 17/0165 701/80
2011/0112720 A1 * 5/2011 Keep ..... B60R 16/02 701/36
2013/0116972 A1 5/2013 Hanatsuka et al.

FOREIGN PATENT DOCUMENTS

JP 11-256542 A 9/1999
JP 2011-242303 A 12/2011
WO 97/13926 A1 4/1997

OTHER PUBLICATIONS

International Search Report for PCT/JP2014/079499 dated Feb. 3, 2015 [PCT/ISA/210].
Written Opinion for PCT/JP2014/079499 dated Feb. 3, 2015 [PCT/ISA/237].
English translation of Written Opinion dated May 19, 2016 from the International Bureau issued in application No. PCT/JP2014/079499.

* cited by examiner

FIG.5A. SIMPLE SPRAY ALGORITHM
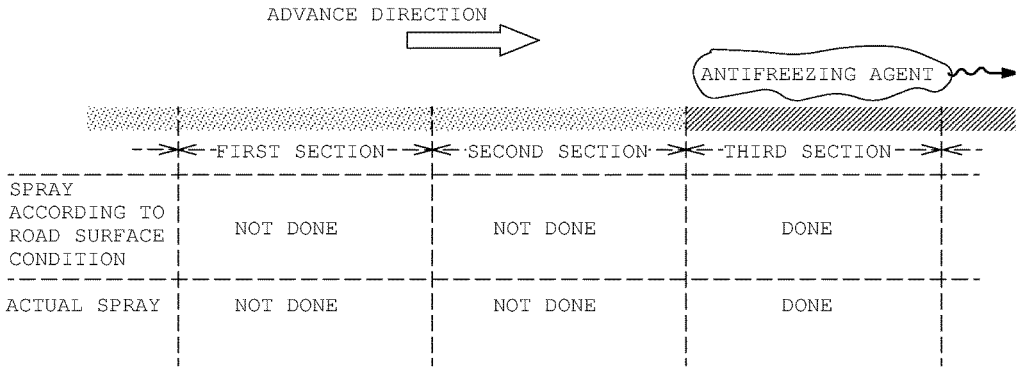
FIG.5B. PARTIAL SPRAY ALGORITHM
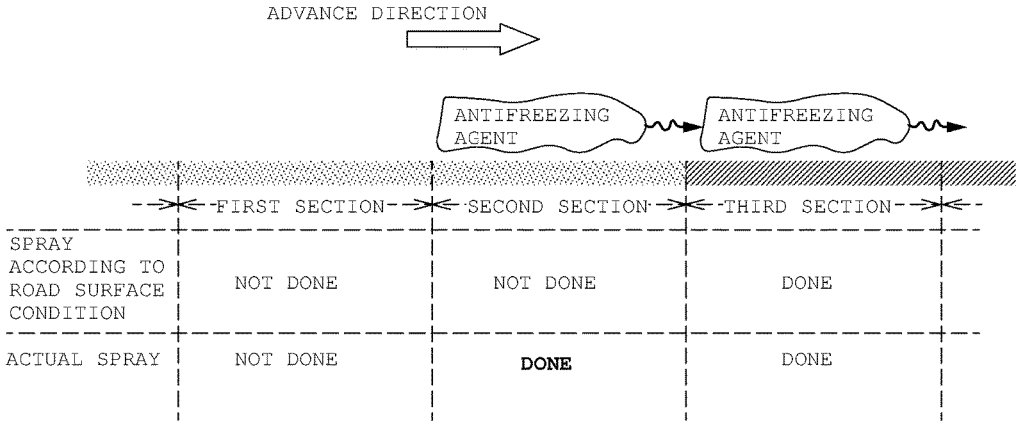
FIG.5C. TOTAL SPRAY ALGORITHM
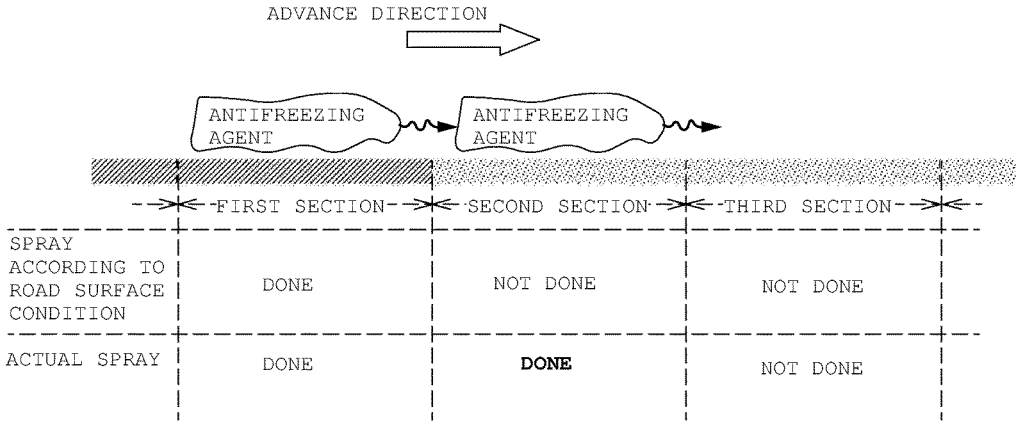

FIG.6

| ROAD SURFACE CONDITION | SPRAY AMOUNT | WET SALT RATIO |
|---|---|---|
| DRY | NO SPRAY | NO SPRAY |
| HALF-WET | 12g/m$^2$ | 17% |
| WET | 10g/m$^2$ | 0% |
| SLOSHY | 15g/m$^2$ | 20% |
| SNOWY | NO SPRAY | NO SPRAY |
| COMPACTED-SNOW | 20g/m$^2$ | 29% |
| ICY | 20g/m$^2$ | 29% |

FIG.7

| | ASCEBDING DATA | | | DESCENDNG DATA | | |
|---|---|---|---|---|---|---|
| SEQUENCE NO. | KP | LATITUDE | LONGITUDE | KP | LATITUDE | LONGITUDE |
| 0 | S0.0 | 43.0777667 | 141.4205333 | S0.0 | 43.0756667 | 141.4208333 |
| 1 | S0.1 | 43.0767000 | 141.4207833 | S0.1 | 43.0748333 | 141.4210333 |
| 2 | S0.2 | 43.0758667 | 141.4210000 | S0.2 | 43.0738333 | 141.4212833 |
| 3 | S0.3 | 43.0750500 | 141.4212000 | S0.3 | 43.0730333 | 141.4214833 |
| · | · | · | · | · | · | · |
| · | · | · | · | · | · | · |
| 2627 | S262.7 | 42.0838000 | 140.5716667 | S262.7 | 42.0838000 | 140.5716667 |
| 2628 | N0.7 | 43.0796167 | 141.4276333 | N0.7 | 43.0802000 | 141.4299000 |
| · | · | · | · | · | · | · |
| · | · | · | · | · | · | · |
| 6964 | F12.0 | 43.7673500 | 141.9805167 | F12.0 | 43.7688167 | 141.9798500 |

FIG.10

| TEST | TEST DATE | TESTED SECTION | NO. OF LANES | SPRAY AMOUNT ($g/m^2$) | SPRAY WIDTH (m) | WET SALT RATIO (%) |
|---|---|---|---|---|---|---|
| FIRST | 2013.3.27 | DOTO EXPRESSWAY FROM OIWAKE IC TO YUBARI IC | 2 LANES | 15 | 5 | 15 |
| SECOND | 2013.4.4 | DOTO EXPRESSWAY FROM OIWAKE IC TO YUBARI IC | 4 LANES | 15 | 5 | 20 |
| THIRD | 2013.4.10 | SAPPORO EXPRESSWAY FROM SAPPORO-NISHI IC TO ASARI IC | 4 LANES | 15 | 8 | 29 |

FIG.11

| TEST | TEST DATE | ROAD SURFACE CONDITION: APPEARING DISTANCE (APPEARING FREQUENCY) | CALCULATED SPRAY AMOUNT (t) | ACTUAL CONSUMPTION AMOUNT (t) |
|---|---|---|---|---|
| FIRST | 2013.3.27 | WET:7.6km(19%) | 0.485 | 0.500 |
| SECOND | 2013.4.4 | WET:2.3km(6%)<br>HALF-WET:1.5km(4%) | 0.228 | 0.250 |
| THIRD | 2013.4.10 | WET:0.5km(1%)<br>HALF-WET:2.2km(5%) | 0.230 | 0.242 |

FIG.12

| AUTOMATIC SPRAY AMOUNT (t) BY SPRAY ALGORITHM | | MANUAL SPRAY AMOUNT (t) BY VISUAL DETERMINATION |
|---|---|---|
| SIMPLE SPRAY ALGORITHM (PINPOINT SPRAY) | 0.132 | 0.178 |
| PARTIAL SPRAY ALGORITHM (MORE SPRAY IN FOREGROUND) | 0.186 | |
| TOTAL SPRAY ALGORITHM (MORE SPRAY BEFORE AND AFER POINT) | 0.228 | |

FIG.14

| ROAD SURFACE CONDITION | DRY | SNOWY | HALF-WET | WET | SLOSHY | COMPACTED-SNOW | ICY |
|---|---|---|---|---|---|---|---|
| SPRA AMOUNT | NONE | NONE | 15g/m² | 15g/m² | 18g/m² | 20g/m² | 20g/m² |
| SOLID AGENT | | | 12.0 g | 13.8g | 14.0g | 14.2g | 14.2g |
| SOLVENT | | | 2.5 m³/m | 1 m³/ m | 3.3 m³/ m | 4.8 m³/ m | 4.8 m³/ m |
| WET SALT RATIO | NONE | NONE | 20% | 8% | 22% | 29% | 29% |

FIG.15

| No. | DATE | TIME | UNIFORM SPRAY | | OPTIMAL SPRAY | | ROAD SURFACE CONDITION | COMPARISON RESULT |
|---|---|---|---|---|---|---|---|---|
| | | | SOLID | SOLVENT | SOLID | SOLVENT | | |
| ① | 2/4 | 9:00 ~10:20 | 3.1t | 1.1 m³ | 2.2t | 0.7 m³ | ICY, DRY | SIGNIFICANT REDUCTION EFFECT BY OPTIMAL SPRAY BECAUSE MUCH OF SECTION WAS DRY ROAD SURFACE |
| ② | 2/4 | 13:30 ~14:30 | 4.8t | 1.6 m³ | 2.2t | 0.3 m³ | DRY, WET, HALF-WET | CONSIDERABLE REDUCTION EFFECT BY OPTIMAL SPRAY BECAUSE DRY ROAD SURFACE WAS ABOUT HALF OF THE WHOLE SECTION |
| ③ | | | 3.1t | 1.1 m³ | 3.0t | 0.3 m³ | WET | NO DIFFERENCE IN SPRAY AMOUNT OF SOLID AGENT, BUT SOME REDUCTION EFFECT OF SOLVENT BECAUSE ALMOST ENTIRE SECTION WAS WET ROAD SURFACE |
| ④ | 2/5 | 14:00 ~15:30 | 2.2t | 0.8 m³ | 2.0t | 0.7 m³ | ICY | NO DIFFERENCE BETWEEN UNIFORM SPRAY AND OPTIMAL SPRAY BECAUSE ALMOST ENTIRE SECTION WAS ICY ROAD SURFACE |
| ⑤ | | | 3.1t | 1.1 m³ | 0.6t | 0.1 m³ | DRY, PARTIALLY WET | CONSIDERABLE REDUCTION EFFECT BY OPTIMAL SPRAY BECAUSE ALMOST ENTIRE SECTION WAS DRY ROAD SURFACE |
| ⑥ | 2/22 | 9:10 ~11:00 | 2.2t | 0.8 m³ | 2.2t | 0.7 m³ | ICY, PARTIALLY COMPACTED-SNOW | NO DIFFERENCE BETWEEN UNIFORM SPRAY AND OPTIMAL SPRAY BECAUSE ALMOST ENTIRE SECTION WAS ICY ROAD SURFACE |
| ⑦ | 3/8 | 17:00 ~18:00 | 4.8t | 1.6 m³ | 4.3t | 0.5 m³ | WET, SLOSHY | NO SIGNIFICANT DIFFERENCE IN SPRAY AMOUNT OF SOLID AGENT, BUT SOME REDUCTION EFFECT OF SOLVENT BY OPTIMAL SPRAY |
| ⑧ | | | 3.1t | 1.1 m³ | 2.6t | 0.4 m³ | WET, SLOSHY, DRY | |
| TOTAL | | | 26.4t | 9.2 m³ | 19.1t | 3.7 m³ | REDUCTION EFFECT OF 28% FOR SOLID AGENT AND 60% FOR SOLVENT | |

APPARATUS, PROGRAM, AND METHOD FOR CONTROLLING AUTOMATIC SPRAY OF ANTIFREEZING AGENT

CROSS REFERENCE TO RELATED APPLICATIONS

This application is a National Stage of International Application No. PCT/JP2014/079499 filed Nov. 6, 2014, claiming priority based on Japanese Patent Application No. 2013-230606 filed Nov. 6, 2013, the contents of all of which are incorporated herein by reference in their entirety.

BACKGROUND OF THE INVENTION

1. Field of the Invention

The present invention relates to an antifreezing agent automatic spray control apparatus, an antifreezing agent automatic spray control program, and an antifreezing agent automatic spray control method for automatically spraying an antifreezing agent according to the surface condition of the road.

2. Description of the Related Art

There has been a practice of known art that when an antifreezing agent is sprayed on the road, a uniform amount of antifreezing agent is sprayed over the entire area of the spray section by an antifreezing agent spraying unit mounted on an antifreezing agent spray vehicle. Also, there has been a method of spraying an antifreezing agent in which a worker evaluates the road surface condition visually and manually operates an antifreezing agent spraying unit according to the result of his evaluation.

On the other hand, another automatic spray system for automatically spraying an antifreezing agent is proposed in Japanese Unexamined Patent Application No. 11-256542 (Patent Document 1). In this system, the vehicle position is detected by GPS, the spray condition data set for the road condition pattern of the detected vehicle position is read out from the road condition pattern database, and the spraying unit is controlled by a control unit according to the read-out spray conditions.

CONVENTIONAL ART DOCUMENT

Patent Document

Patent Document 1: Japanese Unexamined Patent Application No. 11-256542

SUMMARY OF THE INVENTION

Problem to be Solved by the Invention

However, in the above-described manual spraying based on visual evaluation, the road surface condition can be judged with accuracy only by skilled workers. Also, even skilled workers can only evaluate qualitatively with significant variations. And while it may result in a spray amount less than in the above-mentioned uniform spraying, this spray method tends to lead to a spray amount on a safer (ampler) side from the viewpoint of preventing accidents. However, the problem with antifreezing agents is their high cost with their unit prices soaring in recent years and their running up large portions of snow and ice countermeasure expenditures in snowy regions.

Also, the main component of antifreezing agents is sodium chloride. As such, it is known that the antifreezing agents can cause adverse impacts on structural materials, such as concrete, and iron objects, such as guardrails and foundations. In particular, there are reports that the antifreezing agents permeate cracks in concrete, thus negatively affecting the strength and life of structural materials.

On the other hand, according to the invention disclosed in Patent Document 1, it is asserted that the spraying of an antifreezing agent suitable for the road surface condition and the like can be performed. However, in the method as described in Patent Document 1, the road surface condition is determined in real time and the antifreezing agent is sprayed as the spray vehicle runs. In consequence, it is not possible to grasp before the start of spray operation how much antifreezing agent will be required, and hence more than necessary amount of antifreezing agent must be supplied in the hopper or the tank.

If the chemicals left unused on the spray vehicle are left standing for some time, the antifreezing agent may solidify and cause troubles with the spraying unit. Also, it is difficult to perform the spraying of the antifreezing agent with the spray amount changed according to the road surface condition. This resulted in universal spraying over the whole area or partial spraying in wetted areas of melting snow in early and late winter seasons. Hence, the operation has tended to be such that the chemicals are intentionally used completely without recovering them to the chemicals tank unless they are left in a substantial amount. Therefore, it is necessary to grasp the amount of antifreezing agent to be loaded on the spray vehicle beforehand with accuracy if the spraying is to be done with the spray amount changed according to the road surface condition.

The present invention has been made to solve these problems, and an object thereof is to provide an apparatus, program, and method for controlling the automatic spraying of an antifreezing agent that can reduce the cost of the antifreezing agent and the impact of salt damages caused by the antifreezing agent. This is accomplished by reducing the amount of antifreezing agent to be sprayed automatically according to road surface condition and reducing the amount of the antifreezing agent to be left unused on completion of the spray operation by grasping in advance the total required amount of antifreezing agent to be sprayed.

Means for Solving the Problem

An antifreezing agent automatic spray control apparatus according to the preset invention includes a spray section setting unit for setting a spray section for which an antifreezing agent is to be sprayed, a road surface condition data acquiring unit for acquiring road surface condition data showing road surface condition for each of unit sections within the spray section from a storage means, a spray condition data acquiring unit for acquiring spray condition data including a spray amount of the antifreezing agent set according to the road surface condition from the storage means, a spray condition determining unit for determining spray conditions for each of the unit sections based on the road surface condition data and the spray condition data, a total spray amount advance calculating unit for calculating in advance the total spray amount of the antifreezing agent to be sprayed in the spray section based on the spray conditions determined for each of the unit sections, a current position data acquiring unit for acquiring current position data consisting of a latitude and longitude of the current position from a position detecting means, a unit section identifying unit for identifying a unit section corresponding to the current position based on the current position data, and a spray condition outputting unit for outputting the spray conditions for each of the unit sections to an antifreezing agent spraying unit for spraying the antifreezing agent.

Effect of the Invention

According to this invention, the spray amount of antifreezing agent can be reduced by automatically spraying the antifreezing agent according to the road surface condition. And the amount of the antifreezing agent to be left unused on completion of the spray operation can be reduced by grasping in advance the total required amount of antifreezing agent to be sprayed. Thus, the cost of the antifreezing agent and the impact of salt damages caused by the antifreezing agent can be reduced.

BRIEF DESCRIPTION OF THE DRAWINGS

FIG. 5 is diagrams showing (A) spraying by simple spray algorithm, (B) spraying by partial spray algorithm, and (C) spraying by total spray algorithm according to a preferred embodiment.

FIG. 6 is a table showing an example of spray condition data according to a preferred embodiment.

FIG. 7 is a table showing an example of unit section data according to a preferred embodiment.

FIG. 10 is a table showing test conditions of Example 1.

FIG. 11 is a table showing result comparisons of Example 2.

FIG. 12 is a table showing the results of verification of Example 3.

FIG. 14 is a table showing spray conditions used in the simulations of Example 4.

FIG. 15 is a table showing the results of simulations of Example 4.

BEST MODE FOR CARRYING OUT THE INVENTION

Hereinbelow, a description is given of a preferred embodiment each of an antifreezing agent automatic spray control apparatus, an antifreezing agent automatic spray control program, and an antifreezing agent automatic spray control method according to the present invention with reference to the accompanying drawings. It is to be noted that the antifreezing agent meant herein refers to a concept of any chlorides having calcium chloride or the like as the main component, acetic acids not containing chlorides such as calcium acetate or magnesium acetate, or any other substances that can prevent the freezing of moistures on the road surface.

Figure 1:
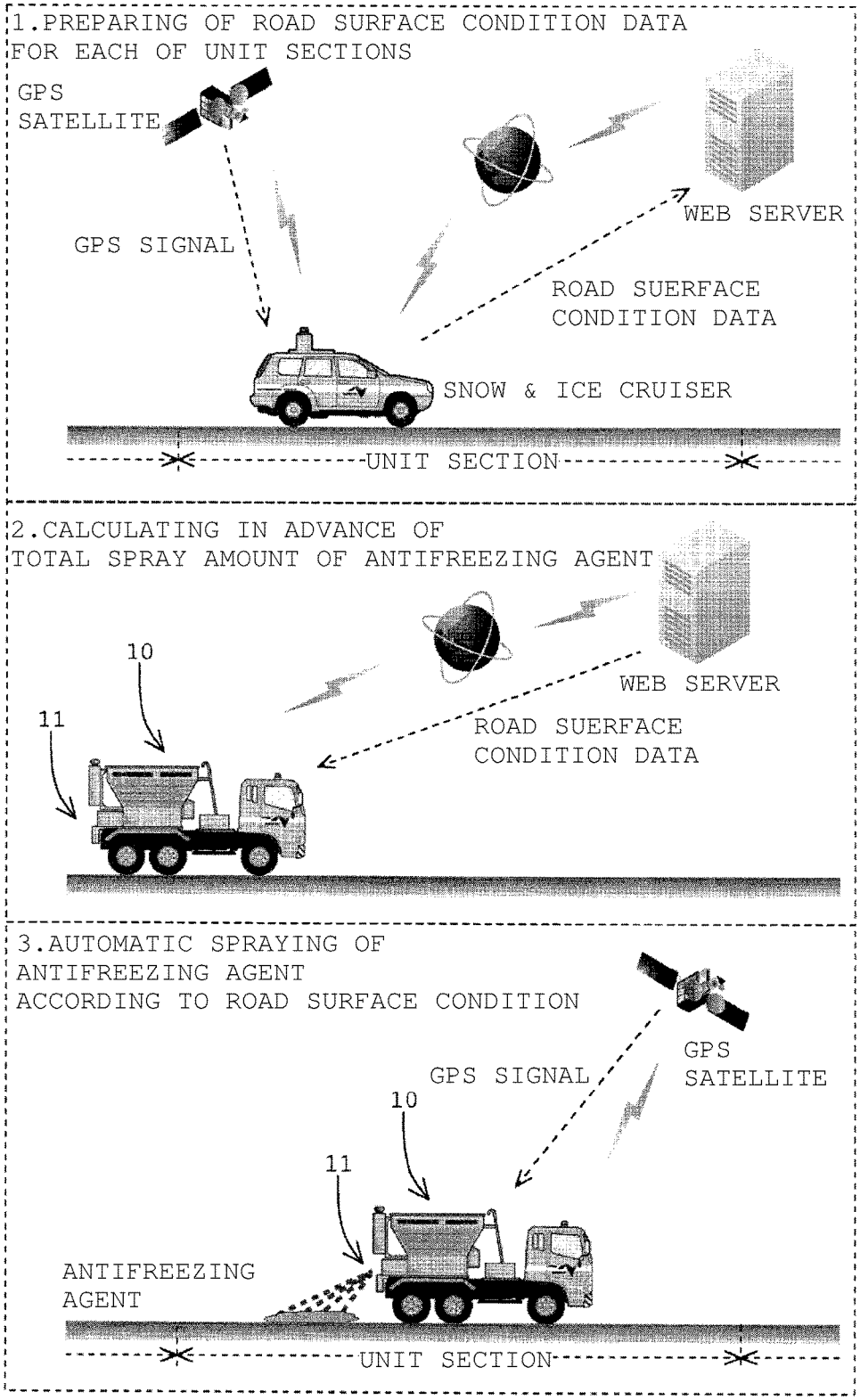
FIG. 1 is illustrations showing the outline of an automatic spray operation of an antifreezing agent using an antifreezing agent automatic spray control apparatus according to the present invention.

Firstly, FIG. 1 shows principal operational processes of automatically spraying an antifreezing agent according to the present embodiment. More specifically, the operation consists of the following operational processes 1 to 3:

1. Road surface condition data showing a road surface condition for each of the unit sections is prepared before the start of spray operation.
2. A total spray amount of an antifreezing agent is calculated in advance based on the road surface condition data.
3. The antifreezing agent is automatically sprayed according to the road surface condition based on current position data.

The operational process 1 is a process in which road surface condition data showing a road surface condition for each of the unit sections within a spray section for which an antifreezing agent is to be sprayed is prepared in advance. The preparation of the road surface condition data can be done, for instance, by the use of CAIS (registered trademark: Contact Area Information Sensing), a tire sensing technology based on the analysis of sensor signals from tire contact surface.

Figure 2:
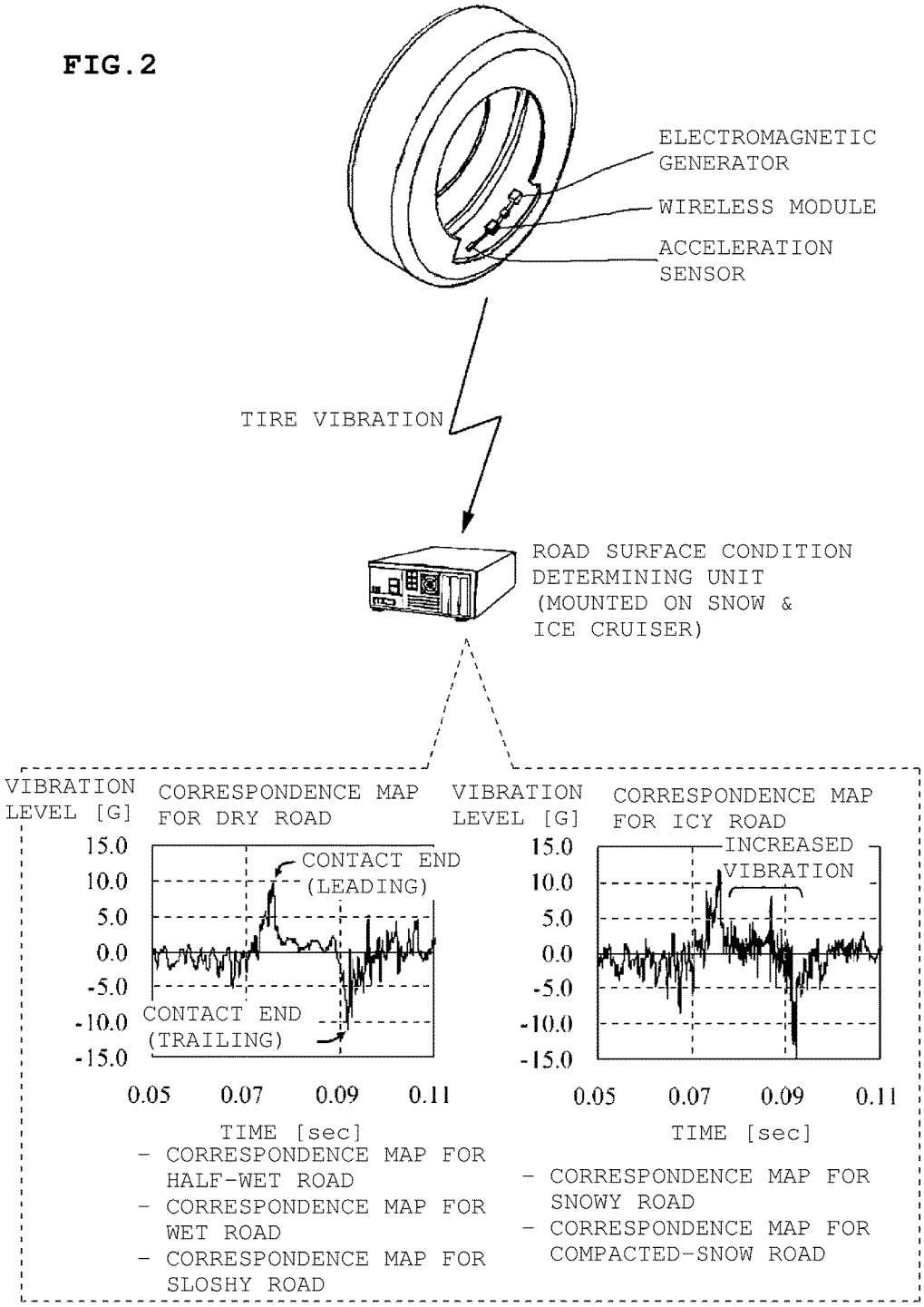
FIG. 2 is illustrations showing an example of a road surface condition determining system according to a preferred embodiment.

To be more specific, in the road surface condition determining system based on CAIS, a road surface condition determining unit is normally mounted on a snow & ice cruiser, and correspondence maps showing the relationship between various road surface conditions and vibration levels are stored in the road surface condition determining unit. Also, as illustrated in FIG. 2, disposed on an inner circumferential surface of a tire of the snow & ice cruiser are an acceleration sensor for detecting the vibration of the tire, a wireless module for wirelessly transmitting the output of the acceleration sensor to the road surface condition determining unit, and an electromagnetic generator to drive these devices.

Having a structure as described above, the road surface condition determining unit acquires the vibration of the tire from the acceleration sensor via the wireless module and at the same time calculates the vibration level from the time-series waveform of the tire vibration. And the road surface condition is determined by checking the calculated vibration level against the above-described correspondence maps. Also, the road surface condition determining unit identifies a unit section corresponding to the current position using the GPS signal during the run of the snow & ice cruiser and generates road surface data by executing the determination processing for each of the unit sections.

In the present embodiment, the road surface conditions are classified into seven conditions (dry, half-dry, wet, sloshy (sherbet-like), snowy, compacted snow, icy), and the vibration levels of quantified waveform characteristics corresponding to the various road surface conditions are registered in advance as the correspondence maps. For example, as shown in FIG. 2, the dry road is characteristic in that the vibration level at the contact surface is low because the tread rubber is restricted by the road surface. Also, the icy road generates high-frequency vibrations within the contact surface because there occur minute slips even during a normal run of a vehicle.

Thus, in the road surface condition determining system based on CAIS, the road surface condition is determined based on the tire vibration which shows characteristic waveforms for different road surface conditions. And the road surface condition data determined for each of the unit sections is transmitted in real time to a WEB server or the like where it is turned into a database. Also, it is possible to send road images or the like together with the road surface condition data, and a monitoring display of these data may be made on a map by a WEB viewer software or the like.

Figure 3:
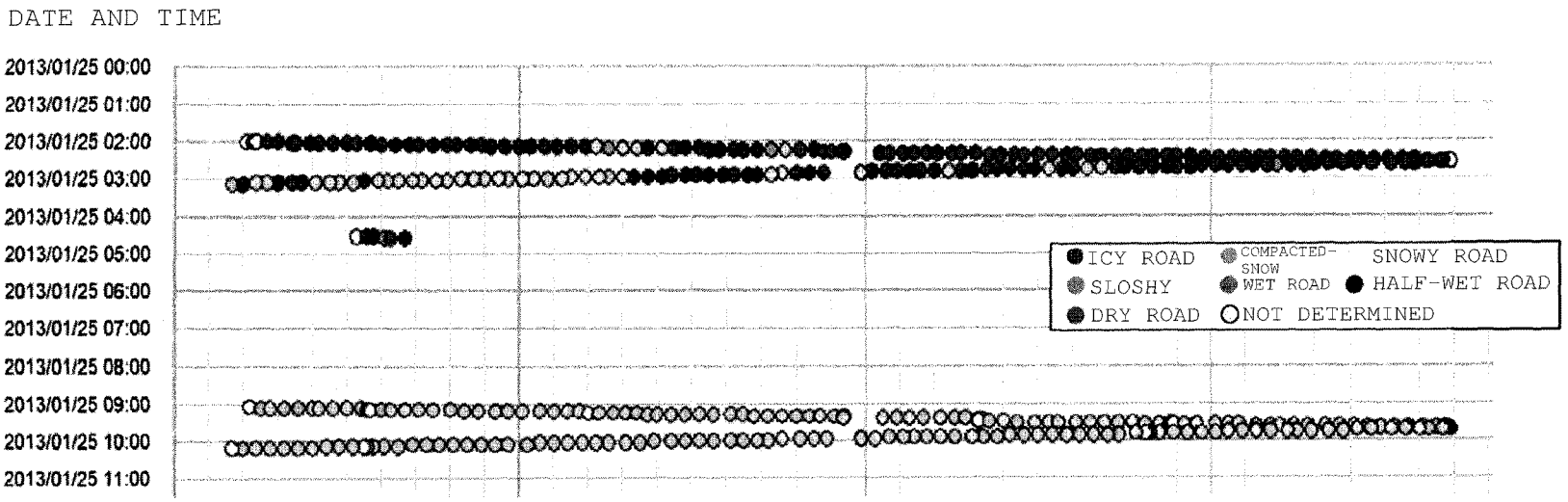
FIG. 3 is a diagram showing an example of road surface condition data according to a preferred embodiment.

Here FIG. 3 shows an example of road surface condition data in the present embodiment. In this embodiment, the unit sections are defined by kilo posts (KP) set at intervals of 100 meters on an expressway, and the road surface condition is registered for each of the unit sections. It is to be noted, however, that the setting yardstick of the unit sections is not limited to the kilo posts, and the unit sections may be set as appropriate. Also, in the present embodiment, the road surface conditions are classified into seven conditions (dry, half-dry, wet, sloshy, snowy, compacted snow, icy), but they are not limited to these types, and may be altered, increased, or decreased as appropriate.

Also, the method for preparing road surface condition data is not limited to the road surface condition determining system based on CAIS. Any method may be employed as appropriate as long as it can grasp the road surface condition for each of the unit sections within the spray section. For example, a worker may determine the road surface condition for each of the unit sections visually, send the determination results to a WEB server or the like, and have them stored in a storage medium such as a USB memory.

Next, the operational processes 2 and 3 are the processes in which the antifreezing agent automatic spray control apparatus 1, the antifreezing agent automatic spray control program 1*a*, and the antifreezing agent automatic spray control method of the present invention play important roles, and a detailed description thereof is given hereinbelow.

Figure 4:
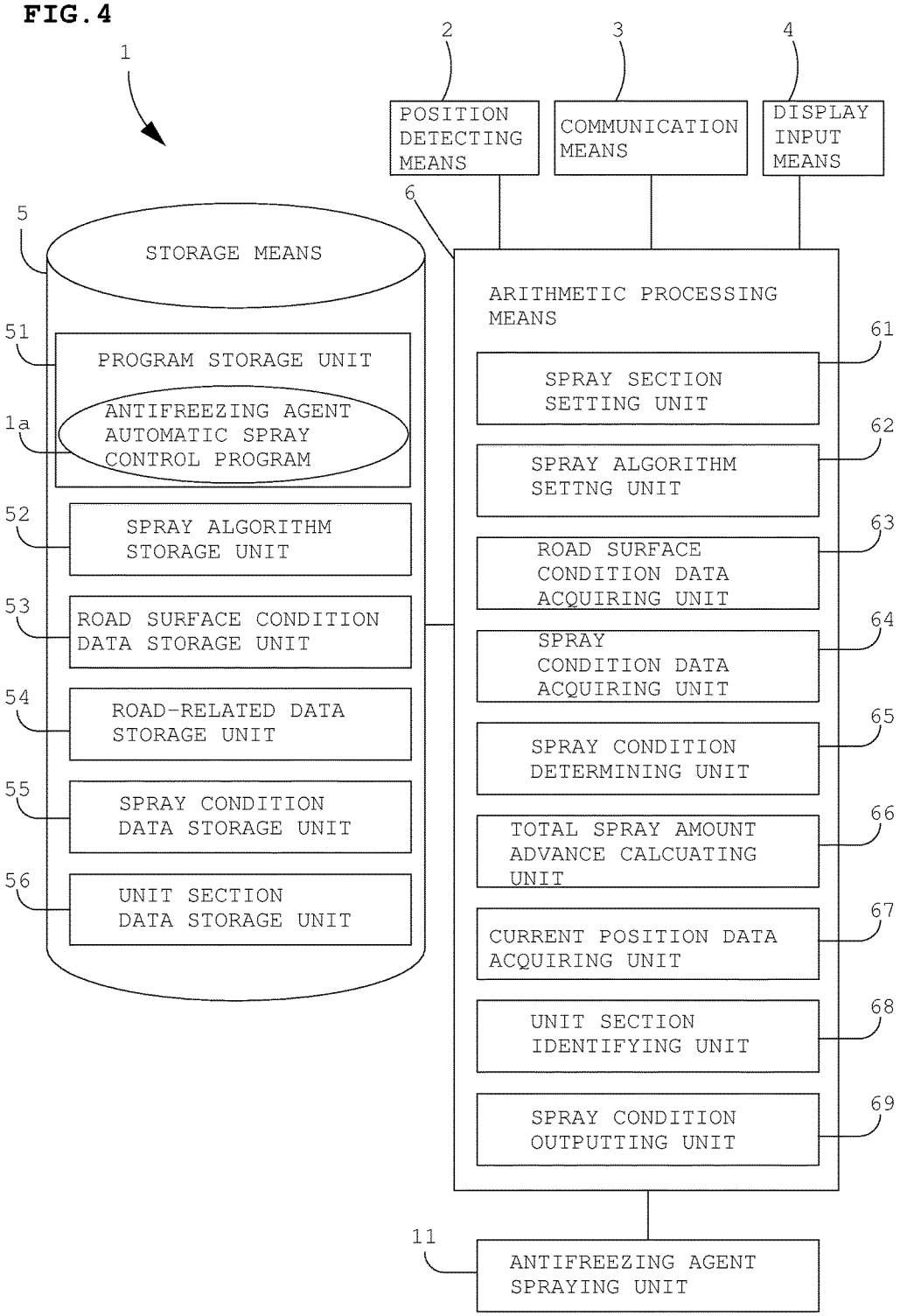
FIG. 4 is a block diagram showing an antifreezing agent automatic spray control apparatus according to a preferred embodiment.

In the present embodiment, the antifreezing agent automatic spray control apparatus 1 is mounted on an antifreezing agent spray vehicle 10 equipped with an antifreezing agent spraying unit 11 for spraying an antifreezing agent. Also, the antifreezing agent automatic spray control apparatus 1 consists of a computer such as a personal computer. As shown in FIG. 4, it mainly includes a position detecting means 2, a communication means 3, a display input means 4, a storage means 5, and an arithmetic processing means 6. Hereinbelow, a detailed description is given of these constituting means.

The position detecting means 2 detects the current position of the antifreezing agent automatic spray control apparatus 1 mounted on the antifreezing agent spray vehicle 10. In the present embodiment, the position detecting means 2, which consists of a GPS (Global Positioning System), receives signals from a GPS satellite at predetermined time intervals and outputs the current position data consisting of a latitude and longitude.

The communication means 3, which gives a communication function to the antifreezing agent automatic spray control apparatus 1, consists of a communication module or the like. The communication means 3 accesses a WEB server or the like on the network via Internet or telephone circuit and thus makes the downloading of road surface condition data possible. In the present embodiment, the communication means 3 is provided for the downloading of road surface condition data from a WEB server. But the communication means 3 is not necessary if road surface condition data is supplied directly to the antifreezing agent automatic spray control apparatus 1 using a USB memory or the like.

The display input means 4, which comprises a touch panel or the like, not only displays a setting screen and the like for spray section, loading amount, etc., to be discussed later, but also allows entry of an intended spray section, loading amount, etc. In the present embodiment, the display input means 4 used has both the display function and input function, but the arrangement is not limited thereto. Instead, a display means equipped only with a display function and an input means equipped only with an input function may be provided separately.

The storage means 5 stores various data and functions as a working area in the arithmetic processing by the arithmetic processing means 6. In the present embodiment, the storage means 5 consists of hard disk, ROM (Read Only Memory), RAM (Random Access Memory), flash memory, etc. As shown in FIG. 4, the storage means 5 include a program storage unit 51, a spray algorithm storage unit 52, a road surface condition data storage unit 53, a road-related data storage unit 54, a spray condition data storage unit 55, and a unit section data storage unit 56. Hereinbelow a detailed description is given of the constituting units.

Installed in the program storage unit 51 is the antifreezing agent automatic spray control program 1*a* of the present embodiment. And with the antifreezing agent automatic spray control program 1*a* executed by the arithmetic processing means 6, the antifreezing agent automatic spray control apparatus 1 as a computer performs the functions of the constituting units to be discussed later.

The spray algorithm storage unit 52 stores spray algorithms to be used in calculating the spray amount in each of the unit sections by the spray condition determining unit 65 to be discussed later. Registered in the present embodiment as the spray algorithms are the simple spray algorithm for the spraying according to the road surface condition in each of the unit sections, the partial spray algorithm adapted for early winter season and late winter season, and the total spray algorithm adapted for mid-winter season.

More specifically, the simple spray algorithm is an algorithm for the spraying directly using the spray conditions selected for the road surface condition in each of the work sections in the same way as disclosed in Patent Document 1. However, part of the antifreezing agent sprayed on the road surface tends to be sent forward in the advance direction of passing vehicles blown by the air pressures of the vehicles. Therefore, let as assume, for instance, a case in which the simple spray algorithm is used in the third section where the spraying of an antifreezing agent is necessary, following the first section and the second section where the spraying of an antifreezing agent is not necessary, as shown in FIG. 5A. In such a case, in the third section, no antifreezing agent comes flying from the preceding first and second sections, and besides part of the antifreezing agent may be blown to the following fourth section. As a result, there may be a possibility of reduced antifreezing effects there.

In contrast to this, the partial spray algorithm of the present embodiment is an algorithm that selects a greater of the values of spray amount corresponding to the road surface condition of the unit section for which the calculation is made and the unit section at least next to the unit section as the spray amount for the unit section for which the calculation is made. Also, the total spray algorithm is an algorithm that selects the largest of the values of spray amount corresponding to the road surface condition of the unit section for which the calculation is made and the unit sections at least before and after that unit section as the spray amount for the unit section for which the calculation is made.

According to the partial spray algorithm, the spray amount for the second section in the above-described example will be determined in such a manner that the spray amount for the third section which is a greater of the spray amounts for the second and third sections is employed as shown in FIG. 5B. As a result, in the third section, the antifreezing agent will be sprayed according to the road surface condition, and besides part of the antifreezing agent will come flying along with the traffic of vehicles from the second section. Thus, this is an algorithm suited to reduce the spray amount while preventing a decline in the antifreezing effect during early or late winter season when it is relatively easy to determine the road surface condition.

Also, let us assume a case where the second and third sections where the spraying of an antifreezing agent is not necessary follow the first section where the spraying of an antifreezing agent is necessary as shown in FIG. 5C. In such a case, according to the total spray algorithm of the present embodiment, the spray amount for the second section will be determined such that the spray amount for the first section, which is the largest of the values of spray amount for the first to third sections, is selected. As a result, in the second section, the antifreezing agent will be sprayed according to the previous road surface condition, and besides part of the antifreezing agent will come flying along with the traffic of vehicles from the first section. Thus, in mid-winter or like season when it is difficult to determine the road surface condition, this proves to be an algorithm suited to reduce the spray amount while retaining the antifreezing effect on a safe side.

It is to be noted that the partial spray algorithm of the present embodiment takes into account the unit section for which the calculation is made and the unit section next to this one only, but the arrangement is not limited thereto. The partial spray algorithm may take into account the spray amounts for the unit section for which the calculation is made and a plurality of unit sections following it. Also, the total spray algorithm of the present embodiment takes into account the unit section for which the calculation is made and the unit sections before and after this one only, but the arrangement is not limited thereto. The total spray algorithm may take into account the spray amounts for the unit section for which the calculation is made and a plurality of unit sections before and after it.

The road surface condition data storage unit 53 stores the road surface condition data showing the road surface condition of each of the unit sections within the spray section. In the present embodiment, the road surface condition data is such that, as described previously, one of the seven road surface condition types (dry, half-wet, wet, sloshy, snowy, compacted snow, and icy) or "not determined" when the determination is difficult is registered for each of the unit sections. Also, the road surface condition data is stored in the road surface condition data storage unit 53 after getting downloaded from a WEB server via the communication means 3. It is to be noted that the road surface condition data may be read out directly from a recording medium such as a USB memory connected to the antifreezing agent automatic spray control apparatus 1. In such a case, the recording medium functions as the road surface condition data storage unit 53.

The road-related data storage unit 54 stores road-related data, such as the width of the road, the number of lanes, and the structure or structures of the road, within the spray section. In the present embodiment, the structure of the road registered is the embanked section or the excavated section. Also, as structures, information on bridges and tunnels is registered.

The spray condition data storage unit 55 stores spray condition data including the spray amount of antifreezing agent set for the road surface condition. In the present embodiment, the spray condition data that is set is the spray amount according to the road surface condition, the spray width according to the width of the road, the wet salt ratio of the antifreezing agent, and the swing (oscillating) directions of the spray nozzles according to the number of lanes. Also, the spray condition data can be changed as appropriate by worker input via the display input means 4.

The antifreezing agent spraying unit 11 of the present embodiment, which has a plurality of spray nozzles arranged horizontally for spraying antifreezing agent, adjusts the spray width by increasing or decreasing the spray nozzles to be used as appropriate. Also, the spray nozzles, which are so configured as to be swingable (oscillatable) right and left, adjust the spray range by changing the swing directions as appropriate. Accordingly, in the present embodiment, the spray conditions that are set are the spray width and swing directions of the spray nozzles according to the number of lanes.

For example, at the point where a two-lane road turns into two lanes on one side of the road, the setting may be such that the spray width is doubled. Or, since the antifreezing agent spray vehicle 10 sprays the antifreezing agent while running on the driving lane of the two lanes, the setting may be such that the spray range of the spray nozzles coves an approximately middle range between the driving lane and the passing lane. This will achieve a reduction in the spray amount because the spray width, even if it is not doubled, can accomplish an appropriate spraying of the antifreezing agent on both the driving lane and the passing lane.

Because of the structural nature of the road, the snow on the road can be easily blown off by winds on the embanked section thereof while the snow on the road tends to get piled up on the shoulder on the excavated section thereof. For that reason, a proper spraying in proportion to the actual road width can be accomplished by setting the spray width wider for the embanked section and narrower for the excavated section. Also, the setting may be such that the spraying of antifreezing agent is carried out irrespective of the road surface condition near the entrance and exit of bridges and tunnels, where it is more slippery.

It is to be noted that the wet salt ratio meant herein is a mixing ratio of wet salt spray in the mixing of solid antifreezing agent (sodium chloride) and liquid antifreezing agent (sodium chloride solution). Hence, in a wet salt spray, changing the spray amount and the wet salt ratio according to the road surface condition proves effective in reducing the spray amount of the antifreezing agent.

Here FIG. 6 shows an example of spray condition data with the spray amounts and wet salt ratios set according to the road surface conditions. In the present embodiment, higher than normal spray amount and wet salt ratio are set for the compacted snow and icy roads which present the slipperiest road surface. On the other hand, lower than normal spray amount and wet salt ratio are set for the half-wet, wet, and sloshy roads which are less slippery and contain more water content than the compacted snow and icy roads. Also, when the road surface condition is dry or snowy, the setting is no spraying because the effect of spraying antifreezing agent is small.

The unit section data storage unit 56 stores unit section data with latitudes and longitudes set in association with the respective unit sections. In the present embodiment, one unit section is the interval between two kilo posts as mentioned already, and the corresponding latitude and longitude are registered for each of the unit sections. It is to be noted that a unit section is identified by determining whether it is within a range of a predetermined shape (circle, square, etc.) centering around a point identified by any latitude and longitude.

Here FIG. 7 shows an example of unit section data showing the correspondence relations between the unit sections and the latitudes and longitudes. In the present embodiment, the unit section data has the ascending data and the descending data associated with the inbound lane and the outbound lane, respectively, of the expressway as shown in FIG. 7. And each data has the corresponding latitude and longitude set for each of the kilo posts (KP) which are equivalent to unit sections.

The arithmetic processing means 6, which consists of CPU (Central Processing Unit) or the like, performs the functions of a spray section setting unit 61, a spray algorithm setting unit 62, a road surface condition data acquiring unit 63, a spray condition data acquiring unit 64, a spray condition determining unit 65, a total spray amount advance calculating unit 66, a current position data acquiring unit 67, a unit section identifying unit 68, and a spray condition outputting unit 69 as shown in FIG. 4 by executing the antifreezing agent automatic spray control program 1*a* installed in the storage means 5. Hereinbelow, a detailed description is given of the constituting units.

The spray section setting unit 61 sets the spray section for which the antifreezing agent is to be sprayed. More specifically, the spray section setting unit 61 acquires input data entered by the worker through the display input means 4 and sets the start point and the turn point of the spray section. Also, in the present embodiment, a plurality of interchange names are registered in advance, and the arrangement is such that the start point and the turn point are selected as appropriate from among them. It is to be noted, however, that the settings of the spray section are not limited to the start point and the turn point, but they may be the start point and the end point.

The spray algorithm setting unit 62 sets the spray algorithm to be used in calculating the spray amount for each of the unit sections by the spray condition determining unit 65. More specifically, the spray algorithm setting unit 62 reads out a spray algorithm from the spray algorithm storage unit 52 when a desired spray algorithm is selected by the worker from various spray algorithms displayed by the display input means 4 and sets the spray algorithm to be used in the calculation of the spray amount. It is to be noted that the present embodiment allows the selection of the simple spray algorithm, the partial spray algorithm, and the total spray algorithm as previously described.

The road surface condition data acquiring unit 63 acquires road surface condition data showing the road surface condition for each of the unit sections within the spray section from the storage means 5. More specifically, the road surface condition data acquiring unit 63 acquires the road surface condition data corresponding to the spray section set by the spray section setting unit 61 from the road surface condition data storage unit 53 and sends it to the spray condition determining unit 65. Also, the road surface condition data acquiring unit 63 may acquire the road surface condition data from a USB memory or the like connected to the input port (not shown) of the antifreezing agent automatic spray control apparatus 1.

The spray condition data acquiring unit 64 acquires spray condition data including the spray amount of antifreezing agent set according to the road surface condition from the storage means 5. More specifically, the spray condition data acquiring unit 64 acquires the spray condition data from the spray condition data storage unit 55 and sends it to the spray condition determining unit 65.

The spray condition determining unit 65 determines the spray condition for each of the unit sections based on the road surface condition data and the spray condition data. In the present embodiment, the spray condition determining unit 65 determines the spray amount and the wet salt ratio for each of the unit sections using the spray algorithm set by the spray algorithm setting unit 62 by checking the road surface condition for each of the unit sections registered in the road surface condition data against the spray amount and the wet salt ratio according to the road surface condition set in the spray condition data.

Also, in the present embodiment, the spray condition determining unit 65 determines the spray width and the swing directions of the spray nozzles by checking the road-related data against the spray condition data. More specifically, the spray condition determining unit 65 determines the spray width and the swing directions for each of the unit sections by checking the various information registered as road-related data in the road-related data storage unit 54 against the spray width and the swing directions set as spray condition data in the spray condition data storage unit 55.

The total spray amount advance calculating unit 66 calculates in advance the total spray amount of antifreezing agent to be sprayed for the spray section based on the spray conditions determined for each of the unit sections. In the present embodiment, the total spray amount advance calculating unit 66 acquires all the spray amounts for the respective unit sections determined by the spray condition determining unit 65 before the start of spray operation and calculates the total spray amount of the antifreezing agent to be sprayed for the spray section by adding them up.

The current position data acquiring unit 67 acquires current position data consisting of the latitude and longitude of the current position from the position detecting means 2. In the present embodiment, the current position data acquiring unit 67 acquires the current position data outputted at predetermined time intervals from the position detecting means 2 and sends it to the unit section identifying unit 68.

The unit section identifying unit 68 identifies the unit section corresponding to the current position. In the present embodiment, the unit section identifying unit 68 identifies the unit section corresponding to the current position by checking the latitude and longitude acquired by the current position data acquiring unit 67 against the unit section data stored in the unit section data storage unit 56.

It is to be noted that, in the present embodiment, the unit section identifying unit 68 determines whether the identified unit sections are along the inbound lane or the outbound lane for a predetermined consecutive number of times. Thus, the identification processing of the unit sections is expedited by referencing only the above-described ascending data when the determination is along the inbound lane consecutively and only the above-described descending data when the determination is along the outbound lane consecutively.

The spray condition outputting unit 69 outputs the spray conditions for each of the unit sections to the antifreezing agent spraying unit 11. In the present embodiment, the spray condition outputting unit 69 reads out the spray amount, wet salt ratio, spray width and swing directions determined by the spray condition determining unit 65 for the current unit section identified by the unit section identified by the unit section identifying unit 68 and outputs them serially to the antifreezing agent spraying unit 11.

Figure 8:
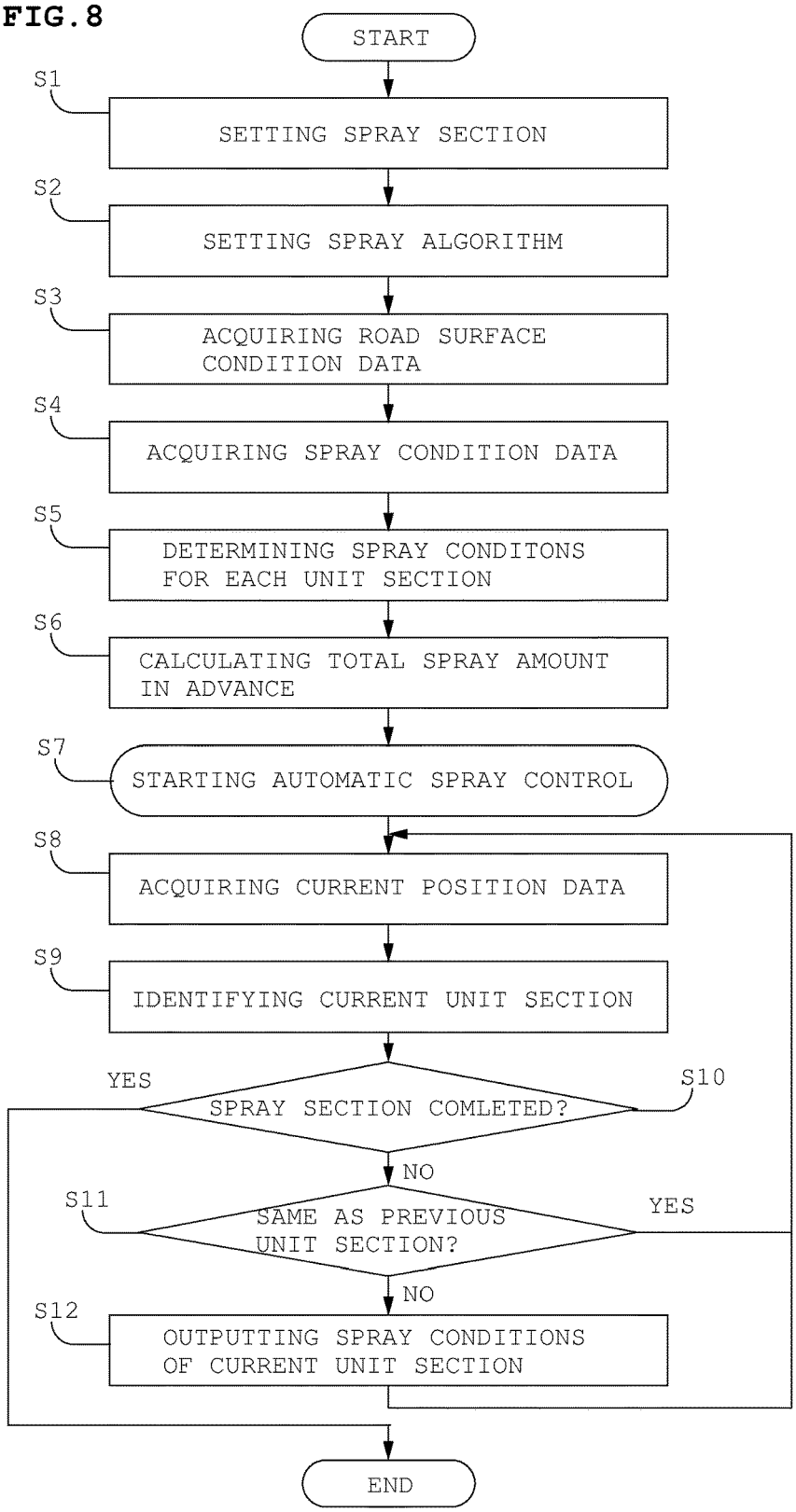
FIG. 8 is a flowchart showing an antifreezing agent automatic spray control method according to a preferred embodiment.

Next, a description is given of the operation of the antifreezing agent automatic spray control apparatus 1 and the antifreezing agent automatic spray control method by executing the antifreezing agent automatic spray control program 1*a* of the present embodiment with reference to FIG. 8 and FIG. 9.

Figure 9A:
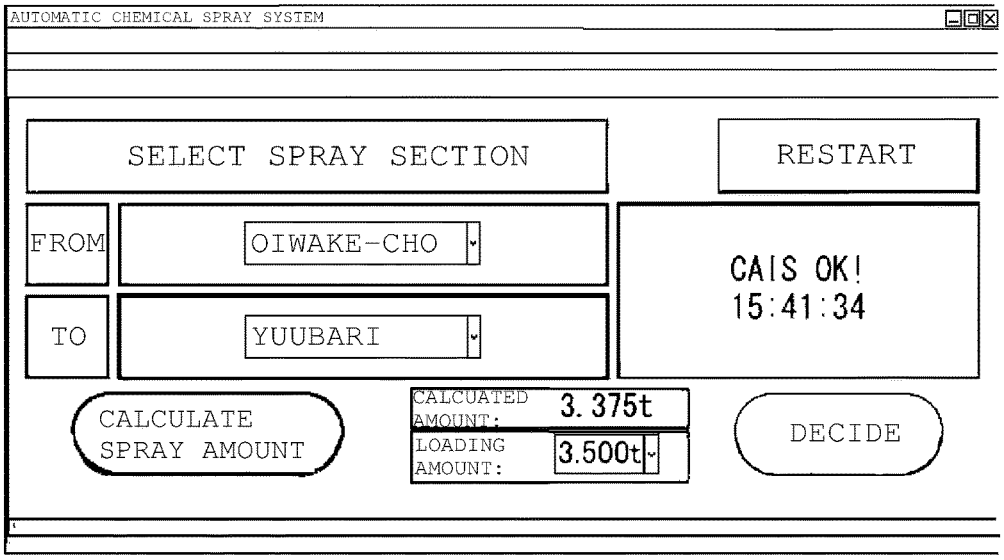
FIG. 9 is illustrations showing examples of operation screen, FIG. 9A being a spray section and loading amount setting screen and FIG. 9B being an auto spray screen, according to a preferred embodiment.

Let us assume a case where an antifreezing agent is automatically sprayed using an antifreezing agent automatic spray control apparatus 1 by executing the antifreezing agent automatic spray control program 1*a* of the present embodiment. First the worker selects a spray section and a spray algorithm on the operation screen as shown in FIG. 9A. Upon this, the spray section setting unit 61 sets the spray section (step of setting spray section: S1), and the spray algorithm setting unit 62 sets the spray algorithm (step of setting spray algorithm: S2).

On completion of the above settings, the worker selects (clicks) the Spray Amount Calculation button on the operation screen as shown in FIG. 9A. Thus, the road surface condition data acquiring unit 63 acquires the road surface condition data corresponding to the set spray section from the road surface condition data storage unit 53 (step of acquiring road surface condition data: S3), and the spray condition data acquiring unit 64 acquires the spray condition data from the spray condition data storage unit 55 (step of acquiring spray condition data: S4). And based on the acquired road surface condition data and spray condition data, the spray condition determining unit 65 determines the spray conditions for each of the unit sections within the spray section (step of determining spray conditions: S5).

At this time, in the present embodiment, the spray condition determining unit 65 determines the spray condition for each of the unit sections, using the spray algorithm set by the spray algorithm setting unit 62. Accordingly, when the partial spray algorithm is used, a greater of the values of spray amount corresponding to the road surface condition of the unit section for which the calculation is made and the unit section at least next to that unit section is selected as the spray amount for the unit section for which the calculation is made. Also, when the total spray algorithm is used, the largest of the values of spray amount corresponding to the road surface condition of the unit section for which the calculation is made and the unit sections at least before and after that unit section is selected as the spray amount for the unit section for which the calculation is made.

Upon the determination of the spray conditions for each of the unit sections by the spray condition determining unit 65, the total spray amount advance calculating unit 66 calculates in advance the total spray amount of the antifreezing agent to be sprayed for the spray section based on the respective spray conditions (step of calculating total spray amount in advance: S6). Thus the total spray amount of the antifreezing agent is grasped in advance before the start of spraying operation of the antifreezing agent. Accordingly, in the present embodiment, as shown in FIG. 9A, the amount of the antifreezing agent to be loaded on the antifreezing agent spray vehicle 10 is determined with a little margin on the calculated total spray amount (calculated amount). As a result, the loading amount may be held minimal, and the amount of the antifreezing agent left unused at the end of spraying operation can be reduced.

The aforementioned operational process 2 is carried out by following the steps as described above (S1 to S6), and the total spray amount of the antifreezing agent is calculated in advance based on the road surface condition data. On the other hand, the aforementioned operational process 3 is carried out by following the steps as discussed in detail below (S7 to S12), and the antifreezing agent is sprayed automatically according to the road surface condition based on the current position data.

Figure 9B:
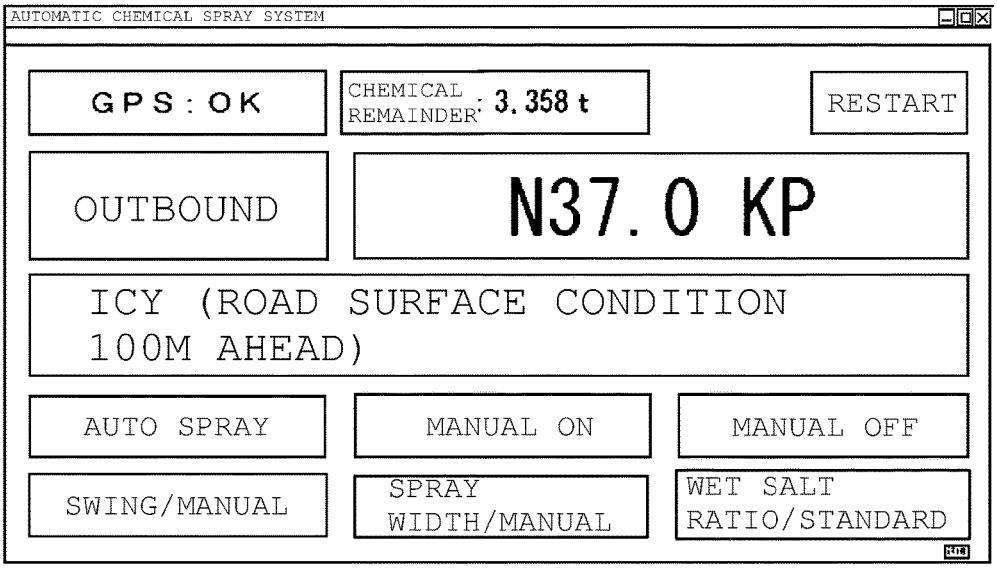

In the present embodiment, as the worker selects (clicks) the Decision button on the operation screen as shown in FIG. 9A, the spray section and the loading amount set by the above-described processing are determined and the auto spray screen as shown in FIG. 9B is displayed. And after the antifreezing agent spray vehicle 10 is moved to the start point of the spray section, the Auto Spray button is selected on the auto spray screen, then the antifreezing agent automatic spray control apparatus 1 starts the automatic spray control of the antifreezing agent (S7).

As the antifreezing agent spray vehicle 10 starts running from the start point of the spray section, the current position data acquiring unit 67 acquires current position data at predetermined time intervals from the position detecting means 2 (step of acquiring current position data: S8). And the unit section identifying unit 68 identifies the unit section corresponding to the current position by checking the latitude and longitude constituting the current position data against the unit section data in the unit section data storage unit 56 (step of identifying unit section: S9). As a result, the unit section is constantly identified by the antifreezing agent spray vehicle 10 during its run.

With the unit section corresponding to the current position identified, it is determined whether the current unit section is the final section of the spray section or not (S10). And if it is the final section (S10: YES), then the automatic spray control processing is completed. On the other hand, if the unit section is not the final section (S10: NO), it is determined whether the current unit section is the same as one identified previously (S11). As a result, if it is the same (S11: YES), the processing returns again to the step of acquiring current position data (S8). And if it is not the same (S11: NO), then the processing goes to the next processing (S12). Accordingly, there is no change in spray conditions while the antifreezing agent spray vehicle 10 is running in the same unit section, and the spray conditions corresponding to the unit section are set whenever the antifreezing agent spray vehicle 10 enters a new unit section.

As the antifreezing agent spray vehicle 10 enters a new unit section, the spray condition outputting unit 69 reads out the spray conditions (spray amount, wet salt ratio, spray width, and swing directions) determined for the current unit section and outputs them to the antifreezing agent spraying unit 11 (step of outputting spray conditions: S12). As a result, the antifreezing agent spraying unit 11 has the spray amount and wet salt ratio according to the road surface condition and the spray width and swing directions according to the width or structure of the road set automatically for each of the unit sections and performs the spraying of the antifreezing agent according to the settings.

By implementing the preferred embodiments as described above, the following advantageous effects can be achieved:

1. The spray amount can be reduced by automatically spraying the antifreezing agent according to the road surface condition.

2. The antifreezing agent can be sprayed fully and effectively and the amount left unused at the end of spraying operation can be reduced by grasping the total spray amount of the antifreezing agent in advance.

3. The reduction in the spray amount and the amount left unused of the antifreezing agent leads to reductions in the cost of the antifreezing agent and the impact of salt damages caused by the antifreezing agent.

4. The setting of the spray algorithm as appropriate can realize an automatic spraying on a safe side or a risky side.

5. By the choice of the partial spray algorithm, the spray amount can be reduced while retaining the antifreezing effect during early winter season or late winter season when it is relatively easy to determine the road surface condition.

6. By the choice of the total spray algorithm, the spray amount can be reduced while retaining the antifreezing effect on a safe side during mid-winter season or like season when it is difficult to determine the road surface condition.

7. The spray amount can be reduced by spraying an antifreezing agent appropriately on both of the two lanes on one side by setting the swing directions of the spray nozzles such that the spray range covers approximately a middle range between the driving lane and the passing lane.

8. The road surface condition can be determined quantitatively and automatically with high accuracy and precision.

Next, a description is given of concrete examples of the antifreezing agent automatic spray control apparatus 1, the antifreezing agent automatic spray control program 1*a*, and the antifreezing agent automatic spray control method according to the present invention.

Example 1

In Example 1, an automatic spray test was conducted on wetted spots of melting snow in late winter, and an on-site verification was made to determine the usability of the antifreezing agent automatic spray control apparatus 1. More specifically, the unit sections used were the 100-meter intervals between kilo posts, and the road surface condition data for each of the unit sections was acquired by a road surface condition determining system mounted on a snow & ice cruiser. And the wetted spots of melting snow were determined based on applicable road surface condition data, and automatic pinpoint spray was carried out using the antifreezing agent automatic spray control apparatus 1 mounted on an antifreezing agent spray vehicle 10.

FIG. 10 shows the test dates, spray sections, and spray conditions of Example 1. It is to be noted that while it was possible to set various spray conditions, simple spray conditions were selected in Example 1 such that the spraying was performed on half-wet and wet road surfaces which were assumed to have wetted spots and no spraying was performed on other road surfaces.

Also, the spray algorithm employed was the total spray algorithm which selects the largest of the values of spray amount corresponding to the road surface condition of the unit section for which the calculation is made and the unit sections before and after that unit section as the spray amount for the unit section for which the calculation is made. That is, in Example 1, an algorithm on a safe side was employed such that a spraying was performed if there was at least one section in need of spraying among the three sections including ones before and after the middle one.

Under the above-described conditions, automatic spray tests were conducted, and as a result, the determination processing of road surface condition by the road surface condition determining system and the automatic spray processing by the antifreezing agent automatic spray control apparatus 1 were carried out properly. And in all of the three tests, the antifreezing agent was sprayed properly with pinpoint precision in sections before and after the wetted spots.

According to Example 1 as described above, it has been proved that the road surface condition can be determined by the road surface condition determining system and the automatic pinpoint spray can be performed by the antifreezing agent automatic spray control apparatus 1.

Example 2

In Example 2, the spray amounts of antifreezing agent calculated by the antifreezing agent automatic spray control apparatus 1 in Example 1 were compared with the actual consumption amounts of the antifreezing agent. It is to be noted that the calculated spray amounts were calculated from the spray width, spray amount, and spray distance, whereas the actual consumption amounts were calculated from the revolving speed of the screw and the specific gravity of the antifreezing agent. As a result, as shown in FIG. 11, it has been confirmed that he calculated spray amounts presented values fairly close to the actual consumption amounts.

Thus, according to Example 2, it has been shown that the antifreezing agent can be sprayed fully and effectively and the amount left unused at the end of spraying operation can be reduced by determining the loading amount based on the total spray amount calculated by the antifreezing agent automatic spray control apparatus 1.

Example 3

In Example 3, consistency between the automatic spraying by the antifreezing agent automatic spray control apparatus 1 and the manual spraying by visual determination of the worker was investigated. More specifically, based on the results of the test on April 4 of Example 1, the total spray amounts were calculated when each of the above-mentioned three types of spray algorithms (simple spray algorithm, partial spray algorithm, total spray algorithm) was employed. Also, after the automatic spray operation, the manual spraying by visual determination was carried out for the same spray section, and the total spray amounts were compared therebetween. FIG. 12 shows the results.

As shown in FIG. 12, the automatic spray amount of which pinpoint spraying was conducted at 100-meter intervals for wetted spots only by the simple spray algorithm was 0.132 tons, which was less than 0.178 tons of the manual spray amount by visual determination. This was because the previously-described flow of the antifreezing agent was not taken into consideration. On the other hand, the automatic spray amount by the total spray algorithm was 0.228 tons, which was slightly more than that of the manual spray amount. This was because the spraying was conducted on a safe side in consideration of 100 meters before and after.

Also, he automatic spray amount by the partial spray algorithm was 0.186 tons, which was of a value fairly close to that of the manual spray amount. This was because the skilled worker started spraying a little ahead in consideration of the tendency of the sprayed antifreezing agent being blown in the advance direction by moving vehicles. Hence, by starting the automatic spray by 100 meters ahead, the spray amount proved to show the values nearly the same as those of the visual determination spray by skilled operators.

According to Example 3 as described above, it has been shown that the spray amount nearly the same as that through visual determination by skilled workers can be achieved by employing the partial spray algorithm. Also, the automatic spraying on a safer side can be realized by employing the total spray algorithm.

Example 4

In Example 4, simulation calculations of spray amounts were made for the case where the antifreezing agent is sprayed uniformly as has been practiced conventionally and the case where optimal spraying is carried out using the above-described simple spray algorithm.

Figure 13:
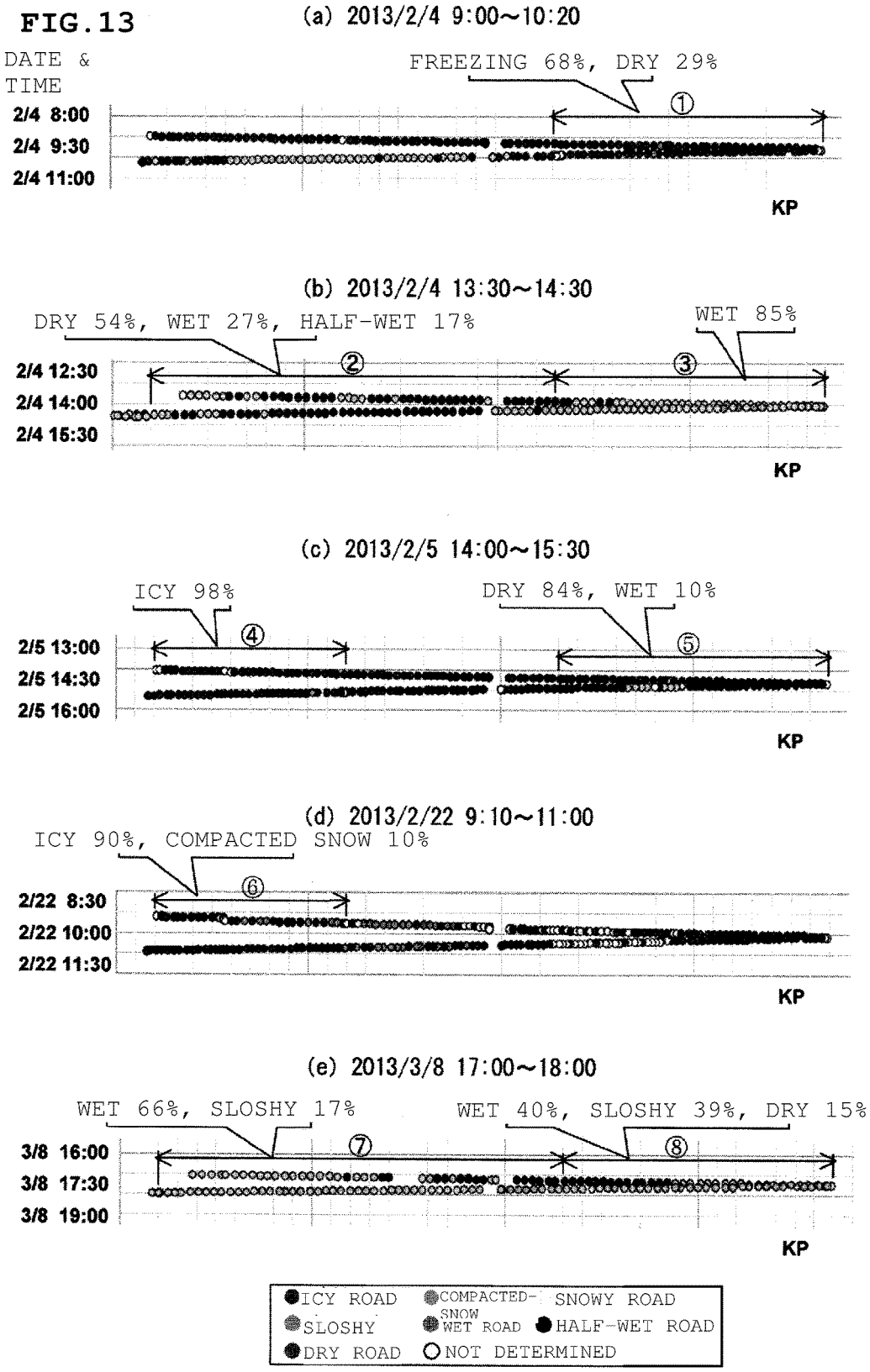
FIG. 13 is a snowy and icy road surface diagrams used in simulations of Example 4.

More specifically, the road surface conditions on a predetermined expressway were determined during the period from February 2013 to March 2013 by a snow & ice cruiser carrying the afore-described road surface condition determining system, and five representative snowy and icy road surfaces showing different road surface conditions were picked up from among them. FIG. 13 shows the road surface diagrams showing when the snowy and icy road surfaces appeared.

Next, as shown in FIG. 13, the sections of encircled 1 to 8 showing different road surface conditions were picked up from among the above-mentioned five snowy and icy road surfaces. And for these 8 sections, simulation calculations of spray amounts were carried out for the case in which uniform spraying as in conventional spraying was done and the case in which optimal spraying according to the spray conditions shown in FIG. 14 was done using the simple spray algorithm. The results are shown in FIG. 15. It is to be noted that in the spray conditions of FIG. 14, about the same spray amount of the solid agent was used while the solvent was reduced according to the road surface condition. Also, for the "half-wet" condition, the spray amount of the solid agent was reduced because the surface of the drainage pavement was slightly wet.

As shown in FIG. 15, of the 8 picked-up cases, the simulation results of Example 4 showed reductions of about 28% of solid agent and about 60% of solvent of the antifreezing agent in optimal spraying according to the spray conditions in comparison with the conventional uniform spraying.

According to Example 4 as described above, of the 8 picked-up cases, it has been proven that the spray amount of the antifreezing agent can be reduced substantially when optimal spraying according to the road surface condition is done using the above-described simple spray algorithm in contrast to when a uniform spraying is done over the entire area of the spray section.

It is to be noted that the antifreezing agent automatic spray control apparatus 1, the antifreezing agent automatic spray control program 1*a*, and the antifreezing agent automatic spray control method according to the present invention are not limited to the embodiments thus far described, but they may be altered or modified as appropriate.

For example, in the present embodiment as described above, the spray algorithm selected by the worker is manually set through the spray algorithm setting unit 62, but the arrangement is not limited thereto. For example, the spray algorithm setting unit 62 may be of such design that a most appropriate spray algorithm is automatically set based on the timing of spraying, outside air temperature, residual salt density on the road surface, etc.

DESCRIPTION OF REFERENCE NUMERALS

1 antifreezing agent automatic spray control apparatus
1*a* antifreezing agent automatic spray control program
2 position detecting means
3 communication means
4 display input means
5 storage means
6 arithmetic processing means
10 antifreezing agent spray vehicle
11 antifreezing agent spraying unit
51 program storage unit
52 spray algorithm storage unit
53 road surface condition data storage unit
54 road-related data storage unit
55 spray condition data storage unit
56 unit section data storage unit
61 spray section setting unit
62 spray algorithm setting unit
63 road surface condition data acquiring unit
64 spray condition data acquiring unit
65 spray condition determining unit
66 total spray amount advance calculating unit
67 current position data acquiring unit
68 unit section identifying unit
69 spray condition outputting unit

The invention claimed is:

1. A method for controlling automatic spray of an antifreezing agent, comprising the steps of:

setting a spray section for which the antifreezing agent is to be sprayed;

acquiring road surface condition data, which is determined based on tire vibrations having characteristic waveforms for different road surface conditions, showing road surface condition for each of unit sections within the spray section from a storage means;

acquiring spray condition data including a spray amount of the antifreezing agent set according to the road surface condition from the storage means;

determining spay conditions for each of the unit sections based on the road surface condition data and the spray condition data;

calculating in advance a total spray amount of the antifreezing agent to be sprayed in the spray section based on the spray conditions determined for each of the unit sections;

acquiring current position data consisting of a latitude and longitude of a current position from a position detecting means;

identifying a unit section corresponding to the current position based on the current position data; and outputting the spray conditions for each of the unit sections to an antifreezing agent spraying unit for spraying the antifreezing agent, wherein the road surface condition includes at least a compacted snow condition.

* * * * *